US005114057A

United States Patent [19]

Ishikawa

[11] Patent Number: 5,114,057

[45] Date of Patent: May 19, 1992

[54] APPARATUS FOR FEEDING SLIDE FASTENER CHAIN WITH FOLDILNG OF ATTACHED FABRIC STRIPS

[75] Inventor: Kiichirou Ishikawa, Marietta, Ga.

[73] Assignee: Yoshida Kogyo K.K., Tokyo, Japan

[21] Appl. No.: 691,981

[22] Filed: Apr. 26, 1991

[51] Int. Cl.[5] ..... A41H 33/00

[52] U.S. Cl. ..... 223/37; 29/766; 29/767; 226/190

[58] Field of Search ..... 223/37; 29/766, 767, 29/768, 408, 409, 33.2; 226/190

[56] References Cited

U.S. PATENT DOCUMENTS

| | | | |
|---|---|---|---|
| 2,836,239 | 5/1958 | Johns et al. | 164/12 |
| 3,872,571 | 3/1975 | Douri | 29/408 |
| 3,936,923 | 2/1976 | Cantor | 29/766 X |
| 4,251,913 | 2/1981 | Clearwater | 29/766 |
| 4,457,062 | 7/1984 | Osaki | 29/766 X |
| 4,625,375 | 12/1986 | Osaki | 29/766 X |
| 4,756,079 | 7/1988 | Kando | 29/409 |
| 4,989,851 | 2/1991 | Maede et al. | 270/41 |
| 5,020,206 | 6/1991 | Yoshida et al. | 29/766 X |

*Primary Examiner*—Werner H. Schroeder
*Assistant Examiner*—Bibhu Mohanty
*Attorney, Agent, or Firm*—Hill, Van Santen, Steadman & Simpson

[57] ABSTRACT

An apparatus for feeding a slide fastener chain with fabric strips attached thereto and including flaps extending over a pair of interengaged rows of coupling elements includes a narrow elongate lower guide member having a central guide groove extending longitudinally in an upper guide surface thereof for receiving and guiding the interengaged rows of coupling elements, and a presser roller disposed adjacent to an upstream end of said lower guide member for resiliently urging the slide fastener chain against the upper guide surface to cause the flaps to engage said upstream end of said lower guide member and then turn down away from the coupling elements on one side of said lower guide member as the slide fastener chain is fed by a feed unit longitudinally along a feed path toward a subsequent processing station.

6 Claims, 6 Drawing Sheets

APPARATUS FOR FEEDING SLIDE FASTENER CHAIN WITH FOLDILNG OF ATTACHED FABRIC STRIPS

BACKGROUND OF THE INVENTION

2. Field of the Invention

The present invention relates to an apparatus for feeding a continuous slide fastener chain having strips of fabric attached to both sides thereof into a subsequent processing station.

2. Description of the Prior Art

In the mass-production of garments, bags, etc. having slide fasteners attached thereto as a closure for openings, it is customary to first sew strips of fabric successively to opposite edges of a continuous slide fastener chain at predetermined intervals. Then, the slide fastener chain with attached fabric strips is fed longitudinally into a subsequent processing station such as a cutting station in which the slide fastener chain is severed transversely between adjacent strips into a succession of slide fasteners of individual lengths. Finally, the fabric strips attached with the slide fasteners are processed or finished into garments, bags, etc. One such known practice is disclosed in U.S. Pat. No. 4,989,851.

In this instance, if the fabric strips 5*a*, 5*b* attached to the slide fastener chain 4 do not extend over a pair of interengaged rows of coupling elements 3, as shown here in FIG. 10, the slide fastener chain with attached fabric strips 2 is fed smoothly and stably because the interengaged rows of coupling elements 3 slidably received in a complementary guide groove serve as a guide means. However, if the fabric strips 5*a*, 5*b* on one or both sides of the slide fastener chain 4 have respective flaps 6, 6*a*, 6*b* extending over the coupling elements 3 as shown in FIGS. 8 and 9, it is no longer possible to use the coupling elements 3 as a guide means and hence an accurate feeding of the slide fastener chain with attached fabric strips 2 is difficult to perform.

Another known practice is disclosed in U.S. Pat. No. 2,836,239, in which trouser fly pieces stitched on opposite edges of a continuous slide fastener and extending over a pair of interengaged rows of coupling elements are folded back away from the coupling elements by upper and lower plows as the slide fastener chain with fly pieces is fed longitudinally into a punching station to form a space devoid of coupling elements. With this folding of the fly pieces, the coupling elements are exposed and hence can be received in and guided along a guide groove extending downstream of the plows. However, since the upper and lower plows are spaced together to form a guide track for the passage therethrough of the slide fastener chain including the folded fly pieces, the fly pieces folded back by the upper and lower plows tend to spring back toward the coupling elements and sometimes overlap and underlap the coupling elements during the feeding of the slide fastener chain. The coupling elements covered with the unbent fly pieces bring about an inaccurate feeding of the slide fastener chain which will result in a working failure at the subsequent punching station.

SUMMARY OF THE INVENTION

With the foregoing difficulties in view, it is an object of the present invention to provide an apparatus for feeding a continuous slide fastener chain accurately into a subsequent processing station even when the slide fastener chain has strips of fabric secured on opposite edges thereof and extending over a pair of interengaged rows of coupling elements.

Another object of the present invention is to provide an apparatus which is simple in construction and capable of feeding a slide fastener chain having attached strips of fabric extending over a pair of interengaged rows of the chain while turning down and holding the fabric strips away from the coupling elements.

According to the present invention, there is provided an apparatus for feeding a slide fastener chain which has a pair of interengaged rows of coupling elements secured on inner edges of respective tapes of a pair of tapes of the slide fastener chain, and strips of fabric secured on outer edges of the tapes at predetermined intervals, at least those of the fabric strips which are attached to one of the tapes having flaps extending over the coupling elements. The feed apparatus comprises an elongate lower guide member having a narrow upper guide surface defining a feed path and a central guide groove extending longitudinally in the guide surface for receiving and guiding the pair of interengaged rows of coupling elements, and a presser roller disposed adjacent to an upstream end of the lower guide member for resiliently urging the slide fastener chain against the upper guide surface to cause the flaps to engage the upstream end of the lower guide member and then turn down away from the coupling elements on one side of the lower guide member as the slide fastener chain is fed longitudinally along the feed path. An elongate upper guide member is disposed immediately downstream of the presser roller and extends over the lower guide member for guiding the slide faster chain between the upper and lower guide members. A feed unit is associated with the upper and lower guide members and frictionally engageable with a central portion of the slide fastener chain including the interengaged rows of coupling elements for feeding the slide fastener chain longitudinally along the feed path.

With this construction, when the slide fastener chain with attached fabric strips is guided into to the feed apparatus, the presser roller resiliently urges the slide fastener chain downward against the upper guide surface of the lower guide member so as to frictionally grip central portions of the respective tapes therebetween, with the interengaged rows of coupling elements slidably received in and guided along the central guide groove. In this instance, the attached fabric strips turn down gravitationally on opposite sides of the lower guide member and the flaps are caused to engage the upstream end of the lower guide member and then progressively turn down away from the coupling on one side of the lower guide block. While the slide fastener chain with attached fabric strips is advanced through the lower guide member, the flaps are kept in a substantially vertical, downwardly folded posture by means of the lower guide member. The flaps are no longer possible to spring back upwardly toward the coupling elements. The rows of coupling elements which are not covered with the flaps are slidably received in the guide groove and serves as a guide means with the result that the slide fastener chain with attached fabric strips is fed accurately and stably into a subsequent processing station.

The fold-down of the flaps only requires a combination of the presser roller and the lower guide member. The feed apparatus having such presser roller and the lower guide member is simple in construction and reliable in operation.

Preferably, the central guide groove has an upstream end terminating short of the upstream end of the lower guide member. The upstream end of the guide groove and the upstream end of the lower guide member jointly constitute means for bending the interengaged rows of coupling elements upwardly and downwardly immediately before they are guided between the presser roller and the lower guide member. With this bending means, the attached fabric strips and the flaps are forced to turned down from the slide fastener chain.

The above and other objects, features and advantages of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

The present invention will be described hereinbelow in detail with reference to a preferred embodiment shown in the accompanying drawings.

Before commencing a description on a feed apparatus 1 (FIG. 1) embodying the present invention, a continuous slide fastener chain with attached strips of fabric to be fed by the feed apparatus will be described.

Figure 2:
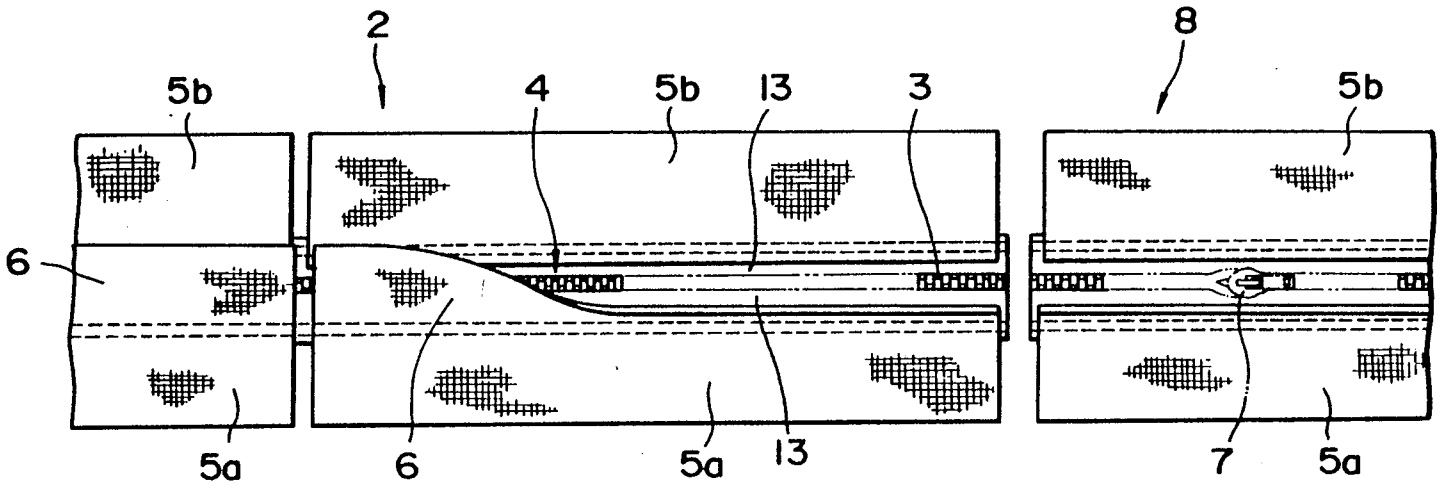
FIG. 2 is a fragmentary schematic plan view of a slide fastener chain having article members which is to be fed by the apparatus.
Figure 8:
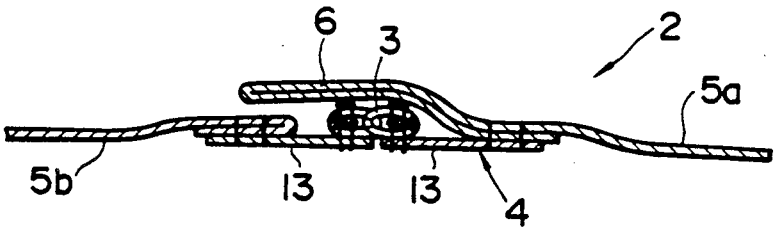
FIG. 8 is a cross-sectional view of a slide fastener chain having article members attached to both sides thereof with article members on one side overlying a pair of interengaged rows of coupling elements.

The continuous slide fastener chain with attached fabric strips generally designated at 2 in FIG. 2 includes a continuous slide fastener chain 4 having a pair of interengaged rows of coupling elements 3 secured on inner edges of respective tapes 13, 13 of a pair of tapes 13, 13, and pairs of opposed elongate strips 5*a*, 5*b* of fabric secured by stitching on outer edges of the respective tapes 13, 13 at predetermined longitudinal intervals. The fabric strips 5*a* on one side of the slide fastener chain 4 have flaps 6 extending over the interengaged rows of coupling elements 3, as clearly shown in FIG. 8.

The continuous slide fastener chain with attached fabric strips 2 (hereinafter referred to as "continuous chain with attached strips") is fed longitudinally by the feed apparatus 1 (FIG. 1) into subsequent processing stations such as a slider-mounting station and a cutting station. In the slider-mounting station, a slider 7 (FIG. 2) is threaded over the rows of coupling elements 3 from the leading end of the slide fastener chain 4. In the cutting station, the slide fastener chain 4 is severed transversely between adjacent fabric strips 5*a*, 5*b*, thereby forming a slide fastener of individual length as generally designated at 8 in FIG. 2. The slide fastener 8 thus produced has one slider 7 and two fabric strips 5*a*, 5*b* on outer edges thereof.

Figure 1:
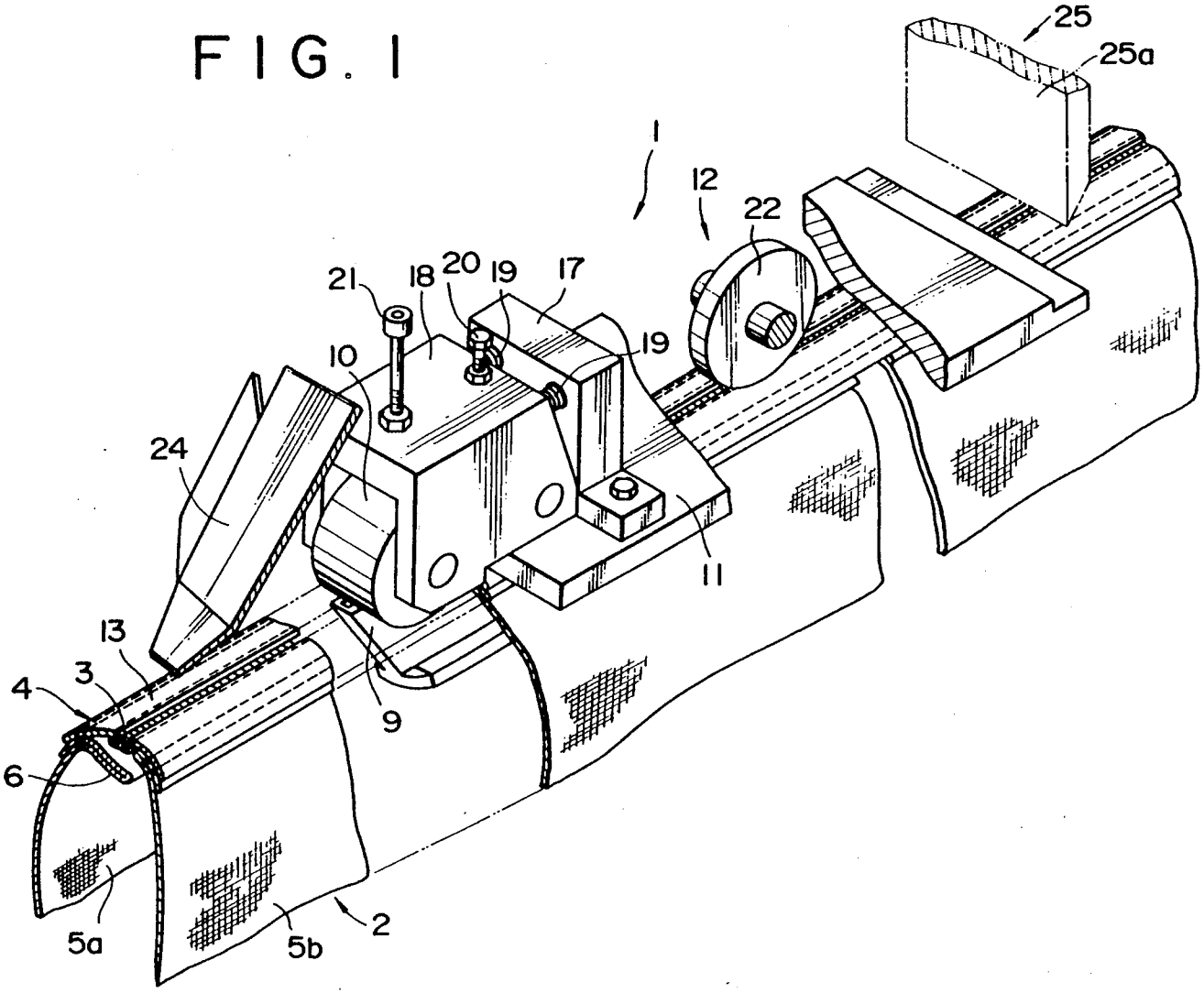
FIG. 1 is a perspective view, with parts cutaway for clarity, of an apparatus embodying the present invention for feeding a continuous slide fastener chain having article members on opposite sides thereof.
Figure 3:
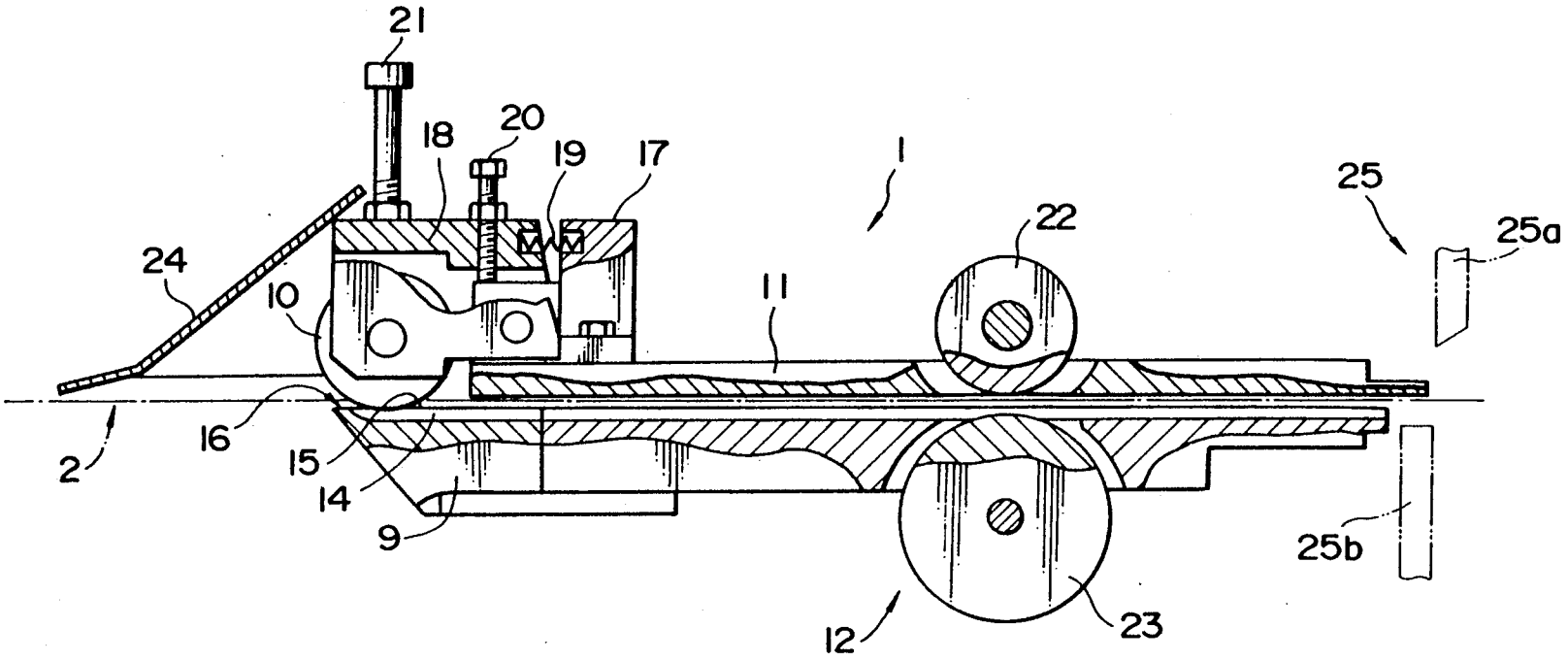
FIG. 3 is a diagrammatical front elevational view, with parts cutaway for clarity, of the apparatus.

As shown in FIGS. 1 and 3, the feed apparatus 1 generally comprises an elongate lower guide member 9 secured to a frame (not shown ) for receiving the continuous chain with attached fabric strips 2 supplied thereto along a horizontal feed path and for supporting and guiding the continuous chain with attached strips 2 as the latter is fed longitudinally through the lower guide member 9, a presser roller 10 disposed adjacent to an upstream end of the lower guide member 9, an elongate upper guide member 11 disposed immediately downstream of the presser roller 10 and extending over the lower guide member 9, and a feed unit 12 associated with the upper and lower guide members 11, 9 at a position downstream of the presser roller 10 for feeding the continuous chain with attached strips 2 downstream along the feed path.

Figure 6:
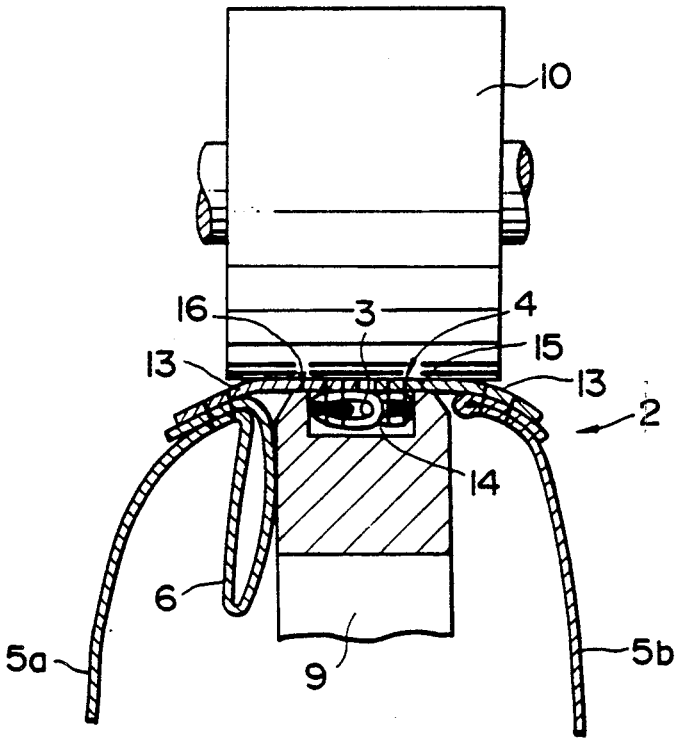
FIG. 6 is a cross-sectional view taken along line VI—VI of FIG. 4.

The lower guide member 9, as shown in FIGS. 3 and 6, has a central guide groove 14 extending longitudinally in an upper guide surface 16 thereof for slidably receiving and guiding the interengaged rows of coupling elements 3 (rows of continuous coiled, monofilamentary coupling elements in the illustrated embodiment). The upper surface 16 is narrow in width and includes a pair of collateral upper guide surface portions 15 on opposite sides of the central guide groove 14. Each of the upper guide surface portions 15 is dimensioned to only engage a central portion of corresponding one of the tapes 13 which extends between the inner edge carrying thereon one row of coupling elements 3 and the outer edge to which the fabric strips 5*a* or 5*b* on the corresponding side are stitched. With the lower guide member 9 having such narrow upper guide surface 16, the attached fabric strips 5*a*, 5*b* and the flaps 6 are caused to turn down on the opposite sides of the lower guide member 9 in the manner, as shown in FIG. 6, as the continuous chain with attached strips 2 is advanced longitudinally along the feed path.

Figure 4:
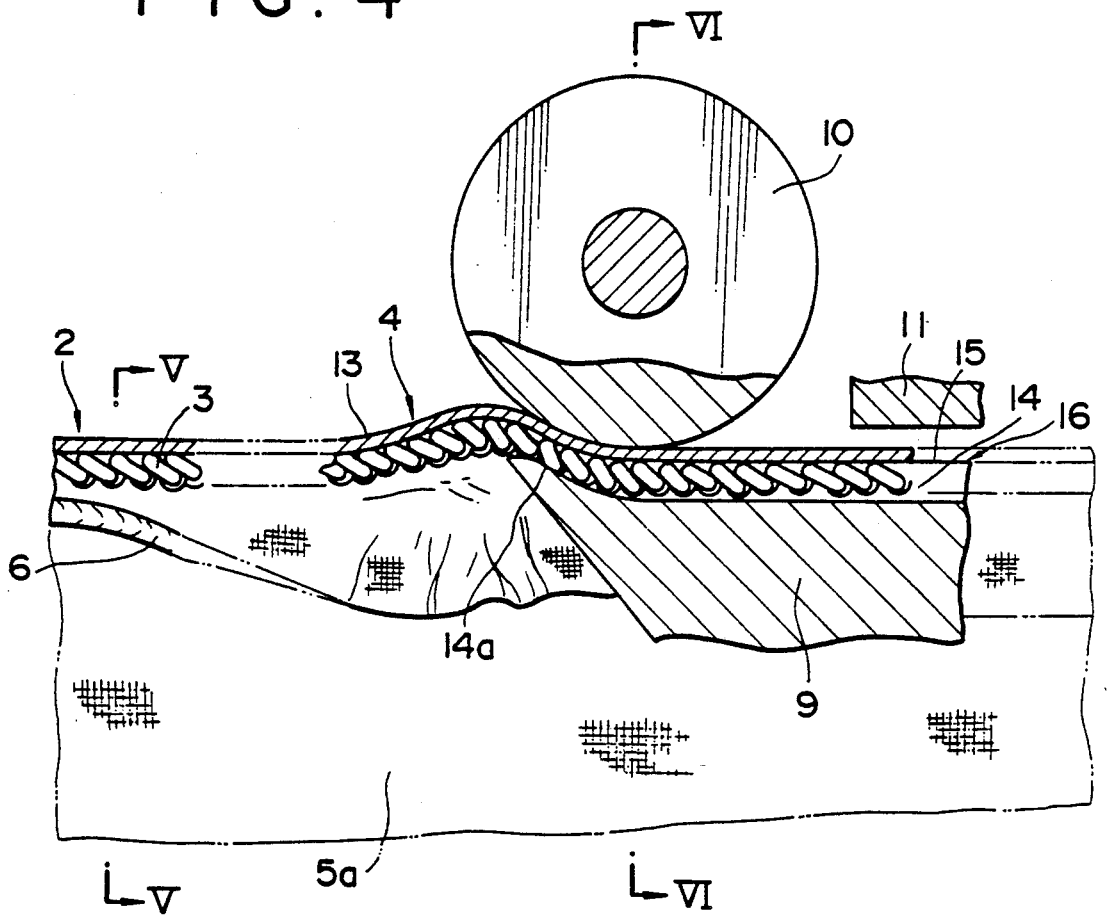
FIG. 4 is an enlarged front elevational view illustrating the manner in which a presser roller of the apparatus urges the slide fastener chain with attached article members against a lower support block.
Figure 5:
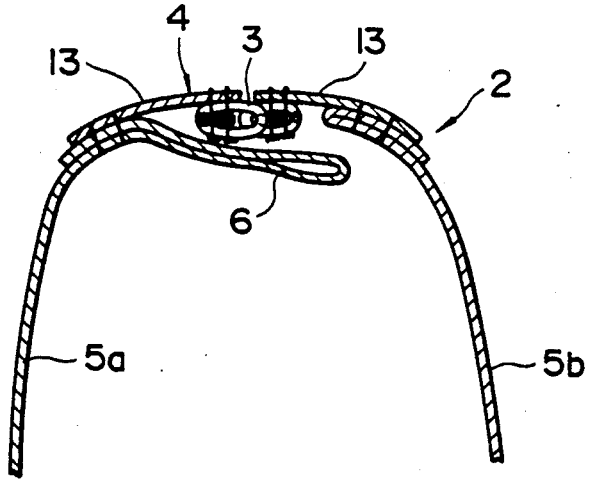
FIG. 5 is a cross-sectional view taken along line V—V of FIG. 4.

As shown in FIGS. 3 and 4, the central guide groove 14 has an upstream end terminating short of the upstream end of the lower guide member 9 and having a curved bottom wall 14*a* (FIG. 4) extending arcuately upwardly and blending into the upper guide surface 16 of the lower guide member 9. With the thus formed upstream end of the guide groove 14, the interengaged rows of coupling elements 3 are temporarily deformed or bent to project upwardly, as shown in FIG. 3, when the continuous chain with attached strips 2 is guided into the feed apparatus 1. As a consequence of this deformation of the interengaged rows of coupling elements 3, the tapes 13 flex correspondingly, thereby causing the attached fabric strips 5*a*, 5*b* to wrinkle as by contracting longitudinally. Thus, the attached fabric strips 5*a*, 5*b* turn down positively with the result that the flaps 6 of the fabric strips 5*a* are forced to turn down away from the coupling elements 3, as shown in FIG. 6, even when the flaps 6 initially extend in a substantially horizontal plane, as shown in FIG. 5.

The presser roller 10 is considerably wider than the lower guide member 9 and, as shown in FIGS. 1 and 3, it is rotatable about its own axis extending transversely across the upper guide surface 16 of the lower guide member 9. The presser roller 10 is rotatably mounted on a generally inverted U-shaped bracket 18 pivoted on an upstanding support member 17 secured to an upper surface of the upper guide member 11. A resilient means comprising a pair of compression coil springs 19 acts between the pivot bracket 18 and the support member 17 to resiliently urge the presser roller 10 against the upper guide surface 16 of the lower guide member 9. An adjustment bolt 20 is threaded through the pivot bracket 18 and engageable with a portion of the support member 17 to adjust the pressure exerted by the presser roller 10 on the continuous chain with attached strips 2. The pivot bracket 18 is provided with a handle 21 which is manipulated by the operator to turn the pivot bracket 18 upwardly away from the feed path when the leading end of the continuous chain with attached strips 2 is set into the feed apparatus 1.

The upper guide member 11 disposed immediately downstream of the presser roller 10 is upwardly spaced from the upper guide surface 16 of the lower guide member 9 so as to define therebetween a length of the feed path for stably and accurately guiding the continuous chain with attached strips 2 into the subsequent processing station after it moves through the presser roller 10. The upper guide member 11 has a width considerably larger than the width of the lower guide member 9, as shown in FIG. 1.

The feed unit 12 includes, as shown in FIGS. 1 and 3, a pair of feed rollers 22, 23 frictionally engageable with opposite sides of a central portion of the continuous chain with attached strips 2 including the interengaged rows of coupling elements 3. The upper feed roller 22 is coupled with a rotary encoder (not shown) for measuring the amount of travel of the continuous chain with attached strips 2. The upper feed roller 22 is urged against the lower feed roller 23. The lower feed roller 23 is connected with a drive means such as an electric motor (not shown) for advancing the continuous chain with attached strips 2 downstream along the feed path. The upper feed roller 22 is urged against the lower feed roller 23 and rotates when the lower feed roller 23 is driven by the motor to advance the continuous chain with attached strips 2. During advancing movement of the continuous chain with attached strips 2, the amount of travel of the continuous chain with attached strips 2 is measured by the encoder in terms of the amount of angular movement of the upper feed roller 22 and when the amount of angular movement of the upper feed roller 22 reaches a predetermined value, the rotation of the lower feed roller 23 is stopped, thereby terminating feeding of the continuous chain with attached strips 2. With the feed unit 12 thus constructed, the continuous chain with attached strips 2 is fed intermittently through a longitudinal distance which is substantially equal to the length of the attached fiber strips 5*a*, 5*b*. The control of such intermittent feeding is well known in the art and hence a further description is not needed.

The feed apparatus 1 further includes an inclined cover 24 disposed upstream of the presser roller 10 so as to cover the front end of the presser roller 10 and an upper surface of the continuous chain with attached strips 2 as the latter is advanced through the feed apparatus 1. The cover 24 serves as a stabilizer to prevent the continuous chain with attached strips 2 from springing upwardly when i is supplied into the feed apparatus 1. With the cover or stabilizer 24 thus provided, the continuous chain with attached strips 2 is guided stably and reliably between the presser roller 10 and the lower guide member 9.

The cutting station disposed downstream of the feed apparatus 1 of this invention includes a cutter 25 composed of an upper blade 25*a* and a lower blade 25*b* which are relatively movably toward and away from each other to sever the continuous slide fastener chain 4 transversely between adjacent fabric strips 5*a*, 5*b* while the continuous chain with attached strips 2 is at rest, thereby producing a succession of slide fasteners 8 of individual lengths (FIG. 2).

The feed apparatus 1 of the foregoing construction operates as follows. To facilitate initial threading of a continuous chain with attached fabrics 2 (FIGS. 2 and 8) through the feed apparatus 1, the pivot bracket 18 is turned upward to retract the presser roller 10 upwardly away from the lower guide member 9. The continuous chain with attached strips 2 is threaded between the presser roller 10 and the lower guide member 9 until the leading end of the continuous chain with attached strips 2 moves past the upper and lower feed rollers 22, 23. In this instance, the continuous chain with attached strips 2 is set such that a pair of interengaged rows of coupling elements 3 is slidably received in the central guide groove 14 of the lower guide member 9, that central portions of respective tapes 13 which extend between inner edges carrying the coupling elements and outer edges attached with fabric strips 5*a*, 5*b* are carried on the upper guide surface portions 15 of the upper guide surface 16 of the lower guide member 9, and that a leading pair of attached fabric strips 5*a*, 5*b* turn down gravitationally with a flap 6 of the attached fabric strip 5*a* is turned back down along a vertical side wall of the lower guide member 9, as shown in FIG. 6. Then, the pivot bracket 18 is released whereupon the presser roller 10 is forced down to its normal working position by means of the compression coil springs 19. Subsequently, the lower feed roller 23 is driven to rotate the upper feed roller 22 together with the lower feed roller 23 so that the continuous chain with attached strips 2 is fed longitudinally along the feed path toward the subsequent processing station. During that time, the presser roller 10 continuously urges the continuous chain with attached strips 2 downward against the upper guide surface 16 of the lower guide member 9 under the resiliency of the compression coil springs 19. Consequently, the continuous slide fastener chain 4 advances through the presser roller 10 and then is guided by and between the upper and lower guide members 9, 11, with central portions of the respective tapes 13 firmly gripped by and between the presser roller 10 and the upper guide surface portions 15 of the lower guide member 9, and with the interengaged rows of coupling elements 3 stably guided along the guide groove 14 in the lower guide member 9. The attached fabric strips 5*a*, 5*b* turn down gravitationally on opposite sides of the lower guide member 9 and the flap 6 of the attached fabric strip 5*a* is kept turned down from the tape 13 by the side wall of the lower guide member 9. The turn-down posture of the fabric strips 5a, 5b and the flap 6 is kept positively and reliably as they are wrinkled as by contracted longitudinally at the leading end of the lower guide member 9, as shown in FIG. 4. The flap 6 is, therefore, no longer possible to spring back upwardly toward the upper guide surface 16 of the lower guide member 9.

A continuous advancing movement of the continuous chain with attached strips 2 causes a next pair of attached fabric strips 5a, 5b to move into the feed apparatus 1. Since the upstream end of the guide groove 14 terminates short of the upstream end of the lower guide member 9 as described above, the interengaged rows of coupling elements are raised or bent upwardly and downwardly immediately before they enter between the presser roller 10 and the lower guide member 9. This bending of the interengaged rows of coupling elements 3 causes the attached fabric strips 5a, 5b and the flap 6 to bend downward even when the flap 6 initially extends in a substantially horizontal plane, as shown in FIG. 5. Consequently, as the continuous chain with attached strips 2 is further advanced, a leading transverse edge of the flap 6 abuts against the front end wall of the lower guide member 9 and then is forced aside by the lower guide member 9, and subsequently the flap 6 is turned down away from the coupling elements 3 and held in a substantially vertical, downwardly folded position by the side wall of the lower guide member 9, as shown in FIG. 6. Thus, the continuous chain with attached strips 2 can be fed accurately and stably into the subsequent processing station.

Figure 7:
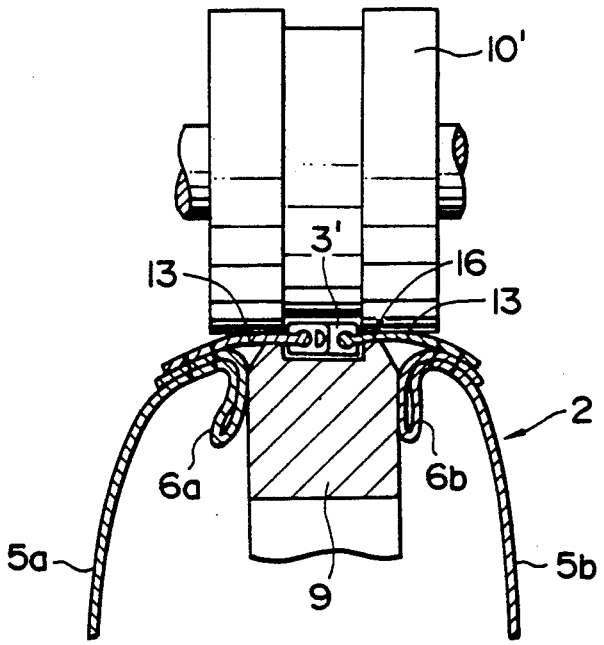
FIG. 7 is a view similar to FIG. 6, but showing the operation of a modified presser roller.

In the embodiment described above, the coupling elements 3 comprise continuous coiled monofilamentary coupling elements carried on one surface of the tapes 13. The feed apparatus of this invention is effectively operative when used with a continuous chain with attached strips 2 having a pair of interengaged rows of discrete coupling elements 3' of metal or synthetic resin, such as shown in FIG. 7. In this instance, however, the presser roller 10 of the foregoing embodiment is replaced with a different presser roller 10' having a circumferential guide groove for receiving and guiding the interengaged rows of discrete coupling elements 3'.

Figure 9:
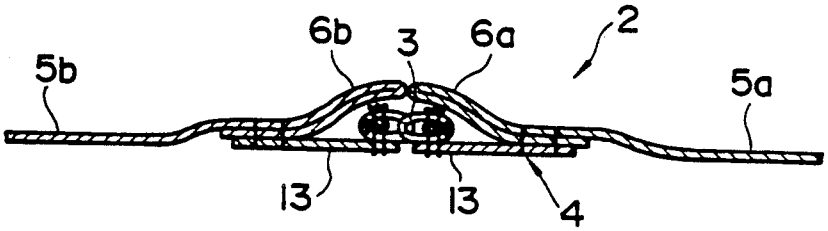
FIG. 9 is a view similar to FIG. 8, showing a slide fastener chain having article members attached to both sides thereof and each overlying corresponding one of a pair of interengaged rows of coupling elements.
Figure 10:
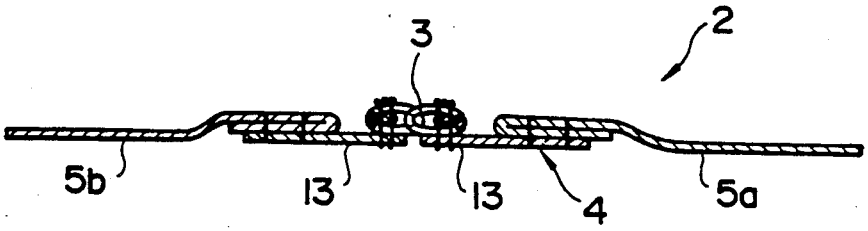
FIG. 10 is a view similar to FIG. 8, showing a slide fastener chain having article members attached to both sides thereof without covering a pair of interengaged rows of coupling elements.

Furthermore, the feed apparatus 1 of this invention an be used with a continuous slide fastener chain 4 having strips 5a, 5b including flaps 6a, 6b extending over corresponding ones of a pair of interengaged rows of coupling elements 3, as shown in FIG. 9. The flaps 6a, 6b of the opposed fabric strips 6a, 6b are folded down away from the coupling elements 3 on opposite sides of the upper guide surface 16 of the lower guide member 9 in the same manner as done with the flaps 6a, 6b shown in FIG. 7. Obviously, a continuous chain with attached strips 2 of the type having exposed coupling elements 3 such as shown in FIG. 10 is also applicable to the feed apparatus of the present invention. Thus, the feed apparatus of this invention can be effectively used with various types of continuous chains with attached strips regardless of the presence of flaps extending over a pair of interengaged rows of coupling elements.

Obviously, various modifications and variations of the present invention are possible in the light of the above teaching. It is therefore to be understood that within the scope of the appended claims the invention may be practiced otherwise than as specifically described.

I claim:

1. An apparatus for feeding a slide fastener chain which has a pair of interengaged rows of coupling elements ,/ secured on inner edges of respective tapes of a pair of tapes of the slide fastener chain, and strips of fabric secured on outer edges of the tapes at predetermined intervals, at least those of the fabric strips which are attached to one of the tapes having flaps extending over the coupling elements, said apparatus comprising:

(a) an elongate lower guide member having a narrow upper guide surface defining a feed path and a central guide groove extending longitudinally in said guide surface for receiving and guiding the pair of interengaged rows of coupling elements;

(b) a presser roller disposed adjacent to an upstream end of said lower guide member for resiliently urging the slide fastener chain against said upper guide surface to cause the flaps to engage said upstream end of said lower guide member and then turn down away from the coupling elements on one side of said lower guide member as the slide fastener chain is fed longitudinally along the feed path;

(c) an elongate upper guide member disposed immediately downstream of said presser roller and extending over said lower guide member for guiding the slide faster chain between said upper and lower guide members; and (d) a feed unit associated with said upper and lower guide members and frictionally engageable with a central portion of the slide fastener chain including the interengaged rows of coupling elements for feeding the slide fastener chain longitudinally along the feed path.

2. An apparatus according to claim 1, further including means for bending the interengaged rows of coupling elements to project upwardly immediately before they are guided between said presser roller and said lower guide member, thereby causing the attached fabric strips and the flaps to turn down positively.

3. An apparatus according to claim 2, wherein said central guide groove has an upstream end terminating short of said upstream end of said lower guide member, said upstream end of said guide groove and said upstream end of said lower guide member jointly constituting said bending means.

4. An apparatus according to claim 3, wherein said upstream end of said guide groove has a curved bottom wall extending arcuately upwardly and blending into said upper guide wall.

5. An apparatus according to claim 1, wherein said upper guide surface is dimensioned to only engage central portions of the respective tapes extending between the inner edges carrying the interengaged rows of coupling elements and the outer edges attached with the fabric strips.

6. An apparatus according to claim 1, further including a cover disposed upstream of said presser roller for preventing the slide fastener chain from jumping upward as it is advanced through the presser roller.

* * * * *